United States Patent [19]

Des Lauriers

[11] 4,237,833

[45] Dec. 9, 1980

[54] VEHICLE THROTTLE STOP CONTROL APPARATUS

[75] Inventor: Edwin D. Des Lauriers, Kokomo, Ind.

[73] Assignee: General Motors Corporation, Detroit, Mich.

[21] Appl. No.: 30,017

[22] Filed: Apr. 16, 1979

[51] Int. Cl.[3] ..... F02D 1/04

[52] U.S. Cl. ..... 123/320; 123/329 123/97 R; 123/124 R

[58] Field of Search ..... 123/97 B, 102, 32 EL, 123/119 EC, 97 R, DIG. 14, 198 DB

[56] References Cited

U.S. PATENT DOCUMENTS

| | | | |
|---|---|---|---|
| 3,027,884 | 4/1962 | Bale, Jr. et al. | 123/97 |
| 3,287,007 | 11/1966 | Schoeppach | 267/1 |
| 3,570,460 | 3/1971 | Rabus | 123/102 |
| 3,577,962 | 5/1971 | Ojala | 123/103 |
| 3,603,298 | 9/1971 | Tadahide et al. | 123/102 |
| 3,645,241 | 2/1972 | Huntzinger | 123/102 |
| 3,700,996 | 10/1972 | Gutting | 123/102 |
| 3,794,003 | 2/1974 | Reddy | 123/97 B |
| 4,108,127 | 8/1978 | Chapin et al. | 123/119 EL |

*Primary Examiner*—Charles J. Myhre

*Assistant Examiner*—Raymond A. Nelli

*Attorney, Agent, or Firm*—Robert M. Sigler

[57] ABSTRACT

A vehicle engine includes throttle stop control apparatus including means effective to store a plurality of induction passage pressure numbers corresponding to specified values of engine speed. Further apparatus measures engine speed and induction passage pressure and compares the induction passage pressure with a control reference number derived from the induction passage pressure reference number corresponding to the measured engine speed. When the throttle is in the idle position and the induction passage pressure signal exceeds the reference, a throttle stop control loop is closed on engine speed to maintain a predetermined engine idle speed. However, when the throttle is in the idle position and the induction passage pressure signal does not exceed the reference, the throttle stop control loop is closed on induction passage pressure to maintain substantially the reference pressure, whereby throttle position during vehicle coastdown is controlled according to a predetermined stored schedule. The control reference number may be shifted between the induction passage pressure number and a higher number as the control is shifted between idle speed and induction passage pressure control to provide hysteresis.

2 Claims, 5 Drawing Figures

VEHICLE THROTTLE STOP CONTROL APPARATUS

BACKGROUND OF THE INVENTION

This invention relates to vehicle engine idle speed control systems. Such systems appear, on some engines, to offer the possibility of improved fuel economy by accurately controlling idle engine speed to the lowest speed consistent with engine and vehicle operability, safety and emission goals while providing for increases in said speed when conditions require.

Such a system may have a movable idle stop and a switch of some sort which indicates contact between the idle stop and some member of the engine throttle mechanism. The movable throttle stop may be positioned by a stepper motor and a closed loop control system which tends to maintain the engine throttle position during idle in accordance with a preset condition. For instance, a number of preset idle speeds corresponding to the desired idle speeds under a number of different engine operating conditions could be stored in a memory and called out to the closed loop idle speed control system in accordance with the sensing of said other engine operating conditions. The closed loop system would repeatedly or continuously measure engine speed, compare it with the reference and actuate the stepper motor to adjust the throttle to decrease the error between actual and desired engine idle speed.

A complication occurs, however, during vehicle coastdown from a high vehicle speed. During this mode of operation, the throttle is generally in idle position, so that the idle speed control system is switched on. However, during most of the coastdown, the coasting vehicle is driving the engine at a higher speed than the preset idle speed. The simple closed loop control system described above does not "know" that it cannot control idle speed under these circumstances; and in the attempt to exert such control, it may close the throttle completely to the closed limit position. It has been the experience of those skilled in the art that some engines may experience a significant increase in the emissions of hydrocarbons when operated under such conditions; and that the way to reduce such emissions is to increase the amount of throttle opening. Devices and systems to crack the throttle open under certain circumstances have been proposed in the past. Such systems generally have comprised a solenoid or vacuum motor to crack the throttle open by a fixed amount upon detection of manifold pressure below a certain reference. Devices of this sort often work well within their design limit; but they do not allow sufficient control over throttle position to optimize this position with regard to all the often conflicting goals of fuel economy, engine braking and emissions throughout the entire vehicle coastdown.

It is an object of this invention to provide a vehicle engine closed loop idle speed control system which permits optimization of engine throttle position during the full range of vehicle coastdown to optimize factors such as engine fuel economy, engine braking and engine emissions.

It is a further object of this invention to provide a closed loop idle speed control system for a vehicle engine which will maintain engine throttle position during a vehicle coastdown according to a predetermined schedule as engine speed decreases.

SUMMARY OF THE INVENTION

These objects and others are achieved in a closed loop idle speed control system for a vehicle engine which includes a movable throttle stop and a stepper motor actuable to move the throttle stop to increase or decrease airflow to the engine when the throttle is in its idle position. The system includes memory elements capable of storing a plurality of values of a manifold pressure reference number corresponding to values of engine speed over a range of engine speed encountered during vehicle coastdown. The memory elements further include one or more reference engine idle speed numbers desirable under a variety of engine operating conditions. The system includes an engine speed sensor and a manifold pressure sensor, each capable of generating a signal usable by the system. When the throttle is in an idle position and the measured manifold pressure exceeds a control reference derived from the induction passage pressure reference number from the memory which corresponds to the engine speed, the system closes the control loop on the engine speed signal with a selected reference engine idle speed number from the memory. However, when the throttle is in the idle position and the induction passage pressure does not exceed the reference, the system closes the control loop on the induction passage pressure signal with the induction passage pressure reference number corresponding to the engine speed. The control reference may be equal to the induction passage pressure reference number under some engine operating conditions or not equal to said induction passage pressure reference number but derived therefrom and close thereto in value under other engine operating conditions.

This system permits closed loop idle speed control during most engine operating conditions and further provides, through the same control apparatus, excellent control of throttle position during vehicle coastdown to optimize said throttle position according to a predetermined schedule as engine speed decreases for the best combination of fuel economy, engine braking and engine emissions. Further objects and advantages of this invention will be apparent from the accompanying drawings and following description of the preferred embodiment.

DESCRIPTION OF THE PREFERRED EMBODIMENT

Figure 1:
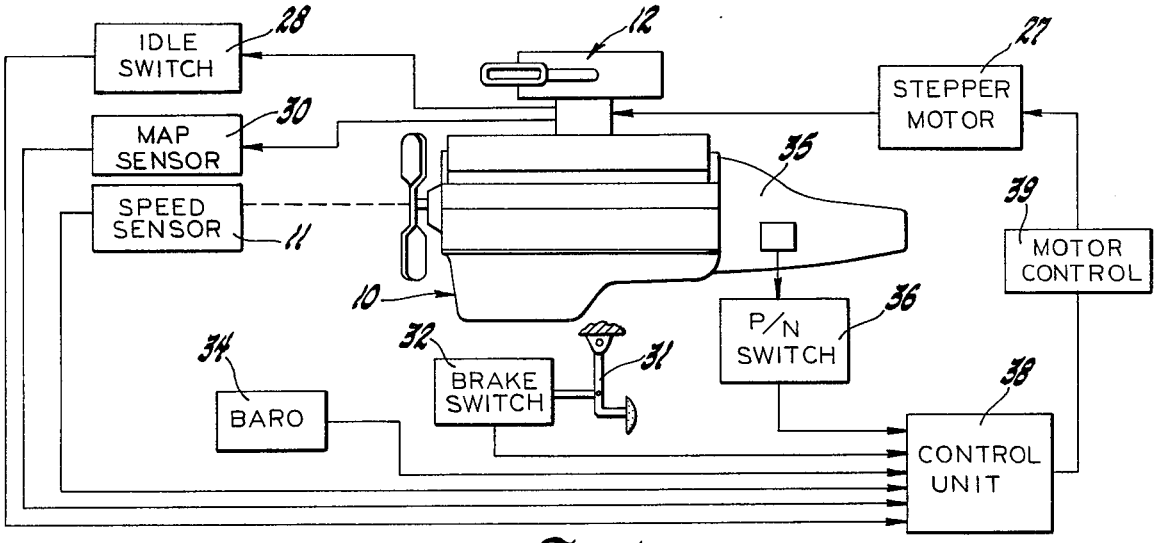
FIG. 1 is a schematic and block diagram of an embodiment of this invention with a vehicle engine.

Referring to FIG. 1, a motor vehicle engine 10 is understood to be mounted in a motor vehicle in the normal manner, although the vehicle itself is omitted from the figure. Engine 10 is of the internal combustion type having a rotating crankshaft, the rotations of which are sensed by a speed sensor 11. Speed sensor 11 may be any appropriate sensor of the type adapted to generate a signal indicative of the rotational speed of the crankshaft. An example of such a sensor is a magnetic pickup adjacent the toothed flywheel of engine 10 coupled to a counter which counts pulses for unit time and supplies such counts on a regular basis.

Figure 2:
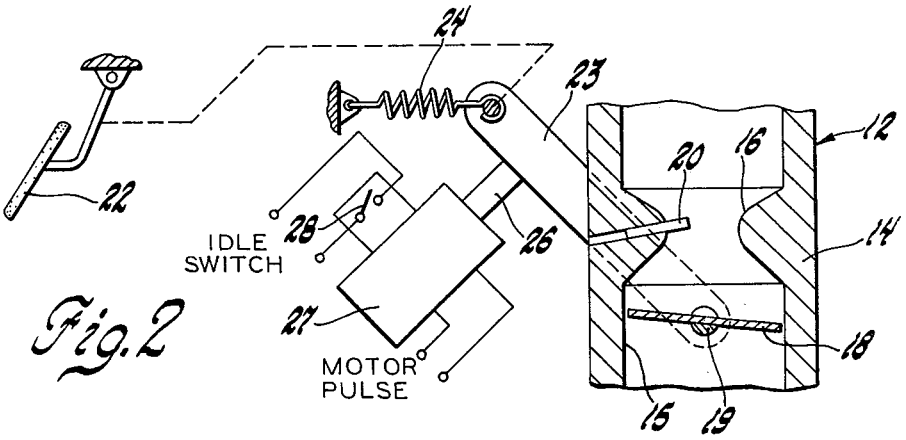
FIG. 2 shows some detail of the throttle control apparatus of FIG. 1.

Engine 10 is supplied with an air-fuel delivery system 12 of the type wherein a throttle in an induction passage controls the flow of air therethrough and additional apparatus supplies fuel sufficient for said flow of air. The specific apparatus shown in FIGS. 1 and 2 is a carburetor of the standard type; however, other types of carburetors, throttle body injection systems, and other fuel injection systems are also suitable. Some detail of the carburetor of this embodiment is shown in FIG. 2. A throttle body 14 defines an induction passage 15 with a venturi 16. A throttle plate 18 below venturi 16 is rotatable on a shaft 19 to control the flow of air through induction passage 15. Standard apparatus 20 for introducing liquid fuel into the air drawn through induction passage 15 may be included in or near venturi 16.

Throttle actuation apparatus for carburetor 12 includes a manual control 22, which may be a standard accelerator pedal as included in most motor vehicles, an actuator lever 23 attached to shaft 19, linkage apparatus, indicated by the dashed line, between pedal 22 and lever 23 and a throttle return spring 24, which biases lever 23 to return throttle plate 18 to a closed position in the absence of vehicle operator pressure on pedal 22. A throttle stop 26 is positioned to stop the closing movement of lever 23 at a predetermined position and thus define an idle position for throttle plate 18 and an idle condition for engine 10. Throttle stop 26 is attached to a stepper motor 27, which is adapted to receive pulses of electric power and, in response, move the throttle stop in a direction to open or close throttle plate 18. Such stepper motors are well known in control systems generally. An idle switch 28, shown schematically in FIG. 2, is associated with stepper motor 27 and throttle stop 26. Idle switch 28 is adapted to be actuated by contact between throttle stop 26 and lever 23 and generate a first output signal when such contact is maintained and a second output signal when there is no such contact. Thus, idle switch 28 normally generates a signal indicative of an idle or non-idle condition for engine 10.

Further associated with induction passage 15 is an induction passage pressure sensor 30, also known as a manifold absolute pressure or MAP sensor, since it is often mounted on the engine intake manifold and calibrated to read absolute pressure. MAP sensor 30 generates a signal indicative of the pressure within induction passage 15 downstream from throttle plate 18.

The vehicle powered by engine 10 includes an operator actuated braking system having a standard brake pedal 31 which, when pressed to actuate the brakes, further actuates a brake switch 32 of the type normally used to cause the lighting of brake lights. Brake switch 32 therefore generates an output indicative of vehicle brakes being applied. An atmospheric pressure sensor 34, which may be mounted on any suitable place on the vehicle where it sees true atmospheric pressure, generates an output signal indicative of the atmospheric pressure. A transmission 35 or the shift linkage associated therewith includes a park neutral P/N switch 36 which generates an output signal when the transmission is in a park or neutral condition: that is, not engaged in a forward or reverse gear.

The system includes a control unit 38 adapted to receive inputs from the various switches and sensors described above and generate output signals at predetermined times to a motor control unit 39. Motor control unit 39 supplies electric power pulses to stepper motor 27, the pulses being of magnitude and direction determined by the output of control unit 39. Control unit 38 includes memory elements capable of storing a plurality of induction passage pressure reference numbers or MAP reference numbers corresponding to engine speed values covering a range of engine speed likely to be traversed during vehicle coastdown. The memory elements of control unit 38 may further store one or more engine idle speed reference numbers for use in idle speed control. Of course, if the selection of the proper engine idle speed reference number depends on one or more engine operating conditions for which sensors or indicators are not shown in FIG. 1, it is understood that such sensors or indicators may be included in the system and may supply output signals to control unit 38.

Control unit 38 is of the type which compares an input signal with a selected reference and generates an error signal having a magnitude and direction which determines the magnitude and direction of the electric power pulse generated by motor control 39. Control unit 38 may choose either a speed signal and speed reference for idle speed control or a MAP signal and MAP reference for manifold pressure or throttle position control. The choice between idle speed or throttle position control is determined by the comparison of sensed MAP with a control reference number derived from the MAP reference number corresponding to the current engine speed. If actual MAP exceeds the control reference number, idle speed control is selected. However, if sensed MAP does not exceed the control reference number, MAP control is selected. In addition, the control reference number is equal to the MAP reference number if the system is currently in idle speed control but is greater than the MAP reference number if the system is currently in MAP control. In this way, hysteresis is provided to reduce switching back and forth between idle and MAP control modes.

Figure 5:
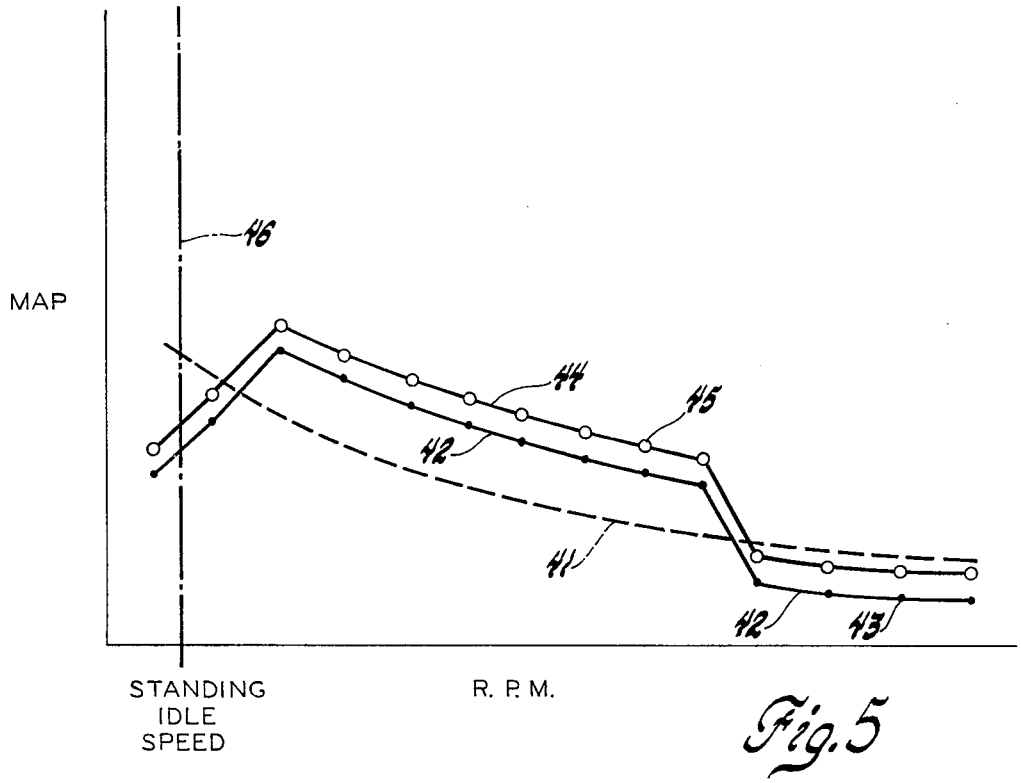
FIG. 5 is a graph of manifold absolute pressure versus engine speed which is useful as a reference in the description of the system of FIG. 1.

Some aspects of this operation may be illustrated with reference to FIG. 5. FIG. 5 is a graph having units of engine speed on the abscissa and units of manifold absolute pressure on the ordinate. The curved dashed line 41 represents a curve of MAP versus engine speed for a constant throttle position or throttle angle. Similar curves for other throttle positions could be generated by merely shifting this curve upward, for an opened throttle, or downward, for a closed throttle, on the graph. A solid curved line having dots 43 spaced therealong is numbered 42 and represents the curve of the MAP reference numbers stored in the memory elements of control unit 38, the dots 43 representing the specific MAP reference numbers corresponding to values of engine speed as shown on the graph. It can be seen that, at each end of line 42, the dots 43 lie well below the dashed line 41; but, in a central range of engine speeds, the dots 43 lie well above dashed line 41. In the central region, the solid line 42 lies generally parallel with line 41; however, that fact is unimportant to the invention and, in fact, a different configuration might well prove to be more advantageous. A major advantage of this invention is that the designer is allowed to construct his line 42, by means of choosing the proper MAP reference values indicated by dots 43, in any shape desired to optimize his throttle control throughout the vehicle coastdown.

If the vehicle is travelling at a high speed and the operator removes his foot from the throttle pedal, the return spring 24 will return the throttle mechanism to an idle position which has a MAP vs RPM curve similar to curve 41 of FIG. 5. Assuming that the engine, which is being driven by the vehicle momentum, is in the upper region of engine speed shown in FIG. 5, the measured MAP will exceed the MAP reference value at the given engine speed. Thus, engine idle speed control will be selected. At this high speed, sufficient air is being driven through the engine that the complete closure of the throttle to its closed limit is not a problem. Therefore the MAP reference values for high engine speeds may be chosen to be below those actual MAP values associated with a completely closed throttle for maximum engine braking and fuel economy. Assuming that line 41 represents the curve of MAP versus engine speed for the closed limit of the throttle, the system will find this curve and follow it, as indicated by the circles, until line 42 crosses above line 41. The speed at which this occurs is chosen to be where the advantages of maximum engine braking are no longer considered as important as the increased emissions which would result from further engine deceleration with a fully closed throttle. Thus, the MAP reference value becomes greater than the fully closed throttle MAP value and the system converts to MAP control. The control or desired value of MAP is chosen to be some increment above the MAP reference value and curve 44 represents the locus of points a pressure increment DELTA above curve 42. The points themselves are represented by circles 45, each of which is derived from a dot 43 immediately below.

Figure 4:
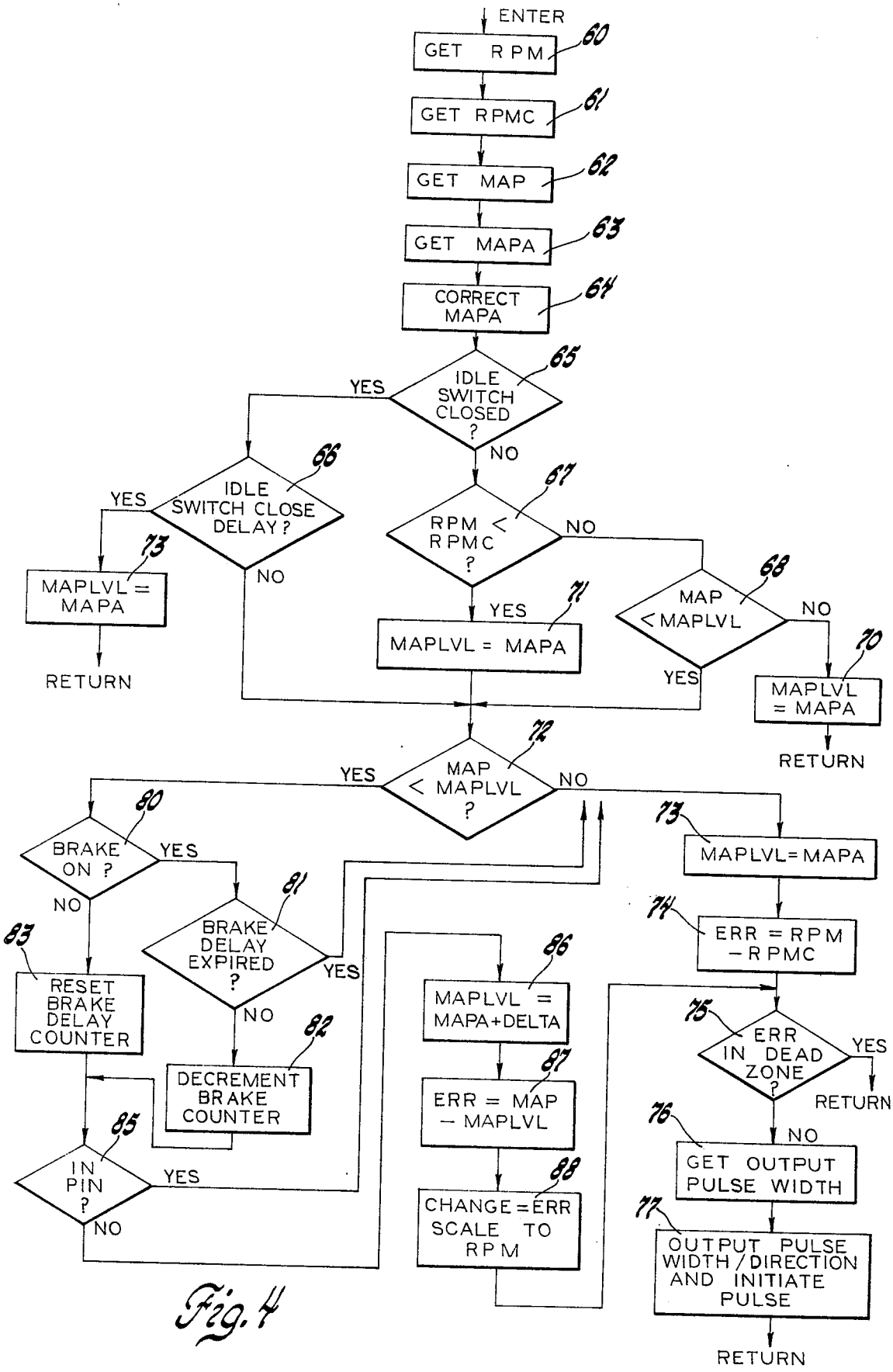
FIG. 4 is a flowchart for the control unit of FIG. 1 which is suitable for use with the computer shown in FIG. 3.

In the central region where line 42 is higher than line 41, MAP will be controlled to a region generally between curves 42 and 44 as explained hereafter in the description of the flowchart of FIG. 4. At the upper and lower extremes of speed, however, where curve 42 lies below curve 41, the system will follow curve 41. The verticle line 46 represents a selected standing idle speed reached when the vehicle coastdown is almost complete and maintained under engine idle speed control.

Figure 3:
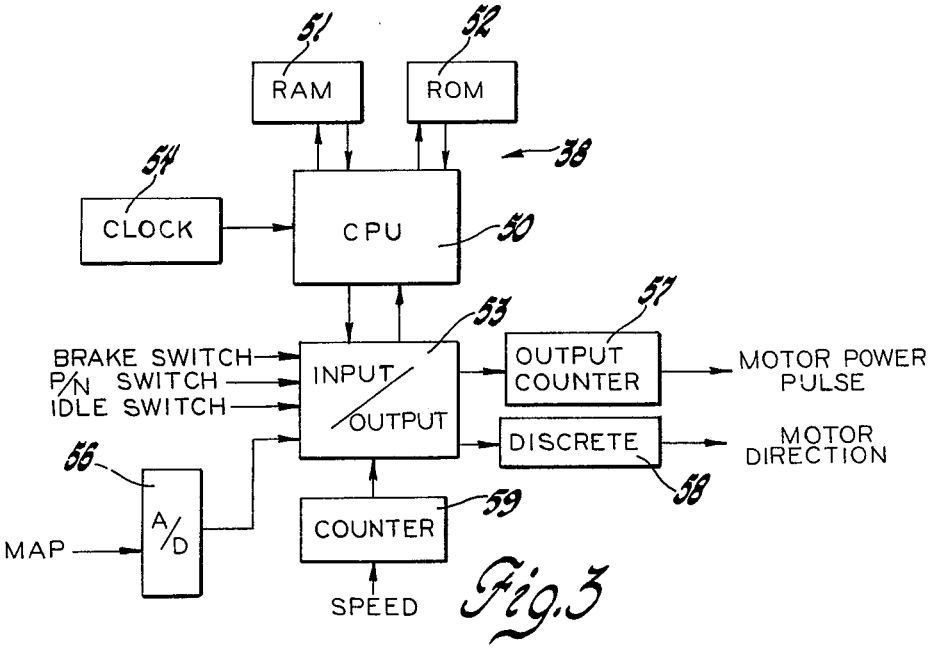
FIG. 3 shows a vehicle mounted computer which is a preferred embodiment of the control unit shown in FIG. 1.

A preferred embodiment of apparatus suitable for use as control unit 38 is shown in FIG. 3. This apparatus is basically a digital computing apparatus comprising a central processing unit or CPU 50, which interfaces in the normal manner with a random access memory or RAM 51, a read only memory or ROM 52, an input/output unit 53 and a clock 54. With the advent of microprocessors and other large scale integrated circuits in chip form, such apparatus may be enclosed in a protective package of negligible size and weight and included on the vehicle in a convenient location. Typical units which might be used include the Motorola 6800 family microprocessor and supporting chips; however, suitable units are available from other manufacturers and may easily be substituted for these.

Since the switches such as brake switch 32, P/N switch 36 and idle switch 28 have binary outputs, these outputs may be input directly to the input/output unit 53. The signals from MAP sensor 30 may be processed in an analog to digital converter 56, the output of which is provided to input/output unit 53. The signals from speed sensor 11 may activate a counter 59 which supplies its count to input/output unit 53. The two outputs of input/output unit 53 comprise a pulse width number, which may be provided to an output counter 57 for determination of the pulse duration and a binary output indicative of motor direction which may be supplied to a discrete output circuit 58.

The digital computing apparatus shown in FIG. 3 may be programmed by anyone skilled in the art according to the flowchart of FIG. 4. The result will be apparatus adapted to perform as the control unit 38 in the system of FIG. 1. The flowchart of FIG. 4 will now be described with reference to the operation of the system.

When the program is begun at the word enter, block 60, GET RPM, provides for the entry of the speed signal from the input/output circuit to the CPU and subsequent storage in RAM 51. The next block 61, GET RPMC, provides for the retrieval of the appropriate desired engine idle speed reference number from ROM 52 and storage in RAM 51. This may include one or more subroutines involved in the selection of the proper speed reference based on such engine operating conditions as coolant temperature, atmospheric pressure, and manifold pressure and such further considerations as transmission condition, air conditioning compressor state and others. Such selection is not a concern of this invention.

Block 62, GET MAP, provides for the introduction of the sensed MAP value to the CPU 50 and then to RAM 51. Block 63, GET MAPA, provides for the retrieval of the MAP reference number, corresponding to the value of RPM, from ROM 52 and storage in RAM 51. This is the same induction passage pressure reference number specified in the claims and elsewhere in the specification. Block 64, CORRECT MAPA, is an optional block which may be included for driving in mountainous areas of high altitude. On mountainous roads, where engine braking is more vital than on lower, flat terrain, it may be desired to shift the optimized throttle position in vehicle coastdown in favor of engine braking. A convenient way of accomplishing this is to adjust or correct the MAPA value at each engine speed according to a predetermined schedule when the output of the atmospheric pressure sensor 34 indicates high altitude. However, as previously stated, this step is optional and is not necessary to the practice of this invention.

Block 65, IDLE SWITCH CLOSED?, provides for the input of the idle switch signal to the CPU and a branch to block 66 if the idle switch is closed and to block 67 if the idle switch is open. It might be thought that, if the idle switch is not closed, there is no need to control the throttle stop position either on the basis on speed or manifold pressure; and that the proper path for the no answer is a return to start. This will occur, proceding through blocks 68 and 70, but only under certain conditions as determined in blocks 67 and 68. Blocks 67 and 68, which permit control of the throttle stop even though the idle switch is not indicated as closed, are included as an additional backup feature in the advent of failure or non-inclusion of the throttle closing limit. It is contemplated that the closed limit position of the throttle might be determined by a subroutine in the stored program of the computing apparatus of FIG. 3. In case it is not so determined, or in case some particular engine operating conditions are encountered in which said subroutine may not be able to fully control the closed limit position of the throttle stop, it may occur that the throttle stop moves to a position beyond which the rest of the throttle apparatus can physically follow. If this were the case, the throttle switch would open; but it would be desirable to control the throttle stop as if the switch were closed. Therefore, block 67 asks if RPM is less than RPMC, the commanded RPM; while block 68 asks if MAP is less than MAPLVL, a quantity which will be explained at a later point in this description. Only if the answer to each of these questions is no will the program proceed through block 70, MAPLVL=MAPA, to the start. If RPM is less than RPMC, the program proceeds through block 71, MAPLVL=MAPA to block 72. If MAP is less than MAPLVL, the program proceeds directly from block 68 to block 72.

If the idle switch is closed, the program proceeds to block 66, which asks if there is an idle switch close delay. Such a delay is desirably built into the system to occur each time the idle switch first closes to allow the settling out of expected transients, particularly in MAP. To accomplish this, timing apparatus of some sort may be actuated every time the idle switch closes. The output of this timing apparatus may be examined to see whether the delay period is still in effect. If it is, the program proceeds from block 66 through block 73, MAPLVL=MAPA, to return to the start. If there is no delay, however, the program proceeds from block 66 directly to block 72, which asks whether MAP is less than MAPLVL.

The quantity MAPLVL is the control reference number which determines whether idle speed control or MAP control will be chosen; and block 72 represents the first point in the flowchart at which that choice is made. The quantity MAPLVL is derived from MAPA and, in this flowchart, may assume one of two values: MAPA or MAPA+DELTA. The quantity MAPLVL may be initially set equal to MAPA for the first run through the flowchart or program; but from then on it will be determined by the program. Blocks 70, 71 and 73, MAPLVL=MAPA, cause MAPLVL to be set equal to the latest value of MAPA. On the other hand, at a later point in this description, a block will be encountered in which MAPLVL is set equal to the latest value of MAPA+a constant, DELTA. With reference to FIG. 5, MAPLVL will be a number determined by engine RPM and represented by one of the dots 43 of curve 42, where it is equal to MAPA, or by one of the circles 45 along curve 44, where it is equal to MAPA+-DELTA.

With reference again to block 72, if MAP is not less than MAPLVL, the system proceeds to block 73, MAPLVL=MAPA and then to block 74, ERR=RPM−RPMC. This path represents the choice of idle speed control; and a number ERR, representing a speed error, is computed as the difference between the actual engine speed and the commanded engine speed. The number ERR has both a magnitude and a sign.

The system proceeds next to block 75, which asks whether the actual speed is within a dead zone on either side of the commanded speed. In order to accomplish this, a subroutine may compare the absolute value of the ERR with a dead zone reference number. If ERR is smaller than the dead zone reference, the actual engine speed is within the dead zone and no correction is desired. Therefore, the system at this point returns to start. If, however, ERR is greater than the dead zone reference in absolute value, the system proceeds to block 76, GET OUTPUT PULSE WIDTH. A subroutine may be included to retrieve from memory an output pulse width corresponding to the absolute value and sign of ERR. This output pulse width may be greater for positive values of ERR, representing low speeds, than for negative values of ERR, representing high speeds, to help prevent engine stall. However, the precise relationship of output pulse width to ERR absolute value and sign is not important to this invention. Whatever the output pulse width and direction may be, it is output through input/output circuit 53, output counter 57 and discrete output circuit 58 to the motor control 39 by block 77 in the flowchart. The correcting pulse is then initiated and the system returns to the start.

Referring again to block 72, if MAP is less than MAPLVL, MAP control is chosen and the system proceeds to block 80, in which it is determined from the output of the brake switch whether the brake is on or applied. It is desired that, after the vehicle brakes have been applied for a certain delay time, the system will revert to or remain in RPM control for maximum engine braking. This function is optional and not absolutely necessary to the practice of the invention. In accordance with this function, if the brake is on, the system proceeds to block 81, BRAKE DELAY EXPIRED? If the answer is yes, the system proceeds to block 73 for RPM control. If the answer is no, however, the system proceeds to block 82, DECREMENT BRAKE COUNTER, which decrements a counter that determines the brake delay. If block 80 determined that the brake was not on, the system would proceed to block 83, RESET BRAKE DELAY COUNTER, which would, the first time it was encountered after a brake delay, reset the brake delay counter for the next time the brakes are applied.

From either block 82 or block 83, the system proceeds to block 85, which checks the signal from P/N switch 36 to see whether the transmission is in park or neutral. If the answer is yes, the system proceeds to block 73 for RPM control. If the answer is no, the system proceeds to block 86, MAPLVL=MAPA+-DELTA, which sets MAPLVL at the higher value for MAP control. Block 87, ERR=MAP−MAPLVL, next computes the MAP error with regard to the desired value MAPLVL. Block 88 then changes the scale of ERR so that the system can proceed directly to block 75 and use the dead zone and output pulse width subroutines and table for RPM in computing the output pulse width under MAP control. This saves memory space that would otherwise have to be allotted for program and data for a MAP control pulse width calculation.

A feature which is provided in this embodiment is the provision of engine braking by downshifting at the option of the vehicle driver. This is not a necessary part of the invention; but it shows the flexibility of design possible with the invention. If the vehicle is in coast-down at a speed where MAP control is in effect—the middle region of the curves of FIG. 5—and the driver desires more engine braking, he may shift to a lower gear. The result will be to increase engine speed into the upper region of the curves of FIG. 5 where RPM control is in effect and the throttle may close for more engine braking.

From the flowchart described above, a programmer can program any appropriate digital computing device to work as part of this invention. The actual program steps and language, appropriate initialization, input and output routines and other details of actual operation should be obvious to the programmer for any particular apparatus and are thus not presented in detail in this specification. Many variations of minor nature are possible within the scope of this invention; and the scope should therefore be limited only by the claims which follow.

The embodiments of the invention in which an exclusive property or privilege is claimed are defined as follows:

1. In a motor vehicle engine having an induction passage, a throttle effective to control the flow of air through the induction passage and further affect the pressure therein and a throttle stop effective to limit closure of the throttle and thus define an idle position therefor, throttle stop control apparatus comprising:

means effective to enerate a desired speed signal;

means effective to generate a signal indicative of engine speed;

means effective to generate a signal indicative of induction passage pressure;

means effective to store a plurality of induction passage pressure reference numbers corresponding to specified values of the engine speed signal through a predetermined engine coastdown speed range;

means effective, when the throttle is in the idle position and the induction passage pressure signal falls below the stored indication passage pressure reference number corresponding to the engine speed signal, to control the throttle stop position to minimize the difference between the induction passage pressure signal and a control reference number which is derived from the aforementioned induction passage pressure number and is at least equal thereto, said means being further effective, when the throttle is in the idle position and the induction passage pressure signal rises above the aforementioned control reference number, to control the throttle stop position to minimize the difference between the engine speed signal and desired speed signal, whereby engine idle speed control may be shifted to engine induction pressure control in a specified engine coastdown speed range to open the throttle according to a predetermined, stored schedule during vehicle coastdown.

2. In a motor vehicle engine having an induction passage, a throttle effective to control the flow of air through the induction passage and further affect the pressure therein and a throttle stop effective to limit closure of the throttle and thus define an idle position therefor, throttle stop control apparatus comprising:

means effective to generate a signal indicative of engine speed;

means effective to generate a signal indicative of induction passage pressure;

means effective to store at least one speed reference number;

means effective to store a plurality of induction passage pressure reference numbers corresponding to specified values of the engine speed signal;

means effective, when the throttle is in the idle position and the induction passage pressure signal falls below the stored induction passage pressure reference number corresponding to the engine speed signal, to control the throttle stop position to minimize the difference between the induction passage pressure signal and a control reference number derived from and greater than the stored induction passage pressure number corresponding to the engine speed signal; and means further effective, when the throttle is in the idle position and the induction passage pressure signal rises above said control reference number, to control the throttle stop position to minimize the difference between the engine speed signal and the speed reference number, loop on the induction passage pressure signal with reference to the control reference number and to increase the control reference number greater than the whereby engine idle speed control may be shifted to engine induction pressure control in at least one specified engine speed range to open the throttle according to a predetermined, stored schedule during vehicle coastdown, the difference between the stored induction passage pressure reference number and greater control reference number derived therefrom providing hysteresis in the shifting.

* * * * *

UNITED STATES PATENT AND TRADEMARK OFFICE

CERTIFICATE OF CORRECTION

PATENT NO. : 4,237,833

DATED : December 9, 1980

INVENTOR(S) : Edwin D. Des Lauriers

It is certified that error appears in the above—identified patent and that said Letters Patent is hereby corrected as shown below:

In the References Cited [56] after "3,603,298 9/1971", "Tadahide et al" should read -- Toda et al --.

Column 9, claim 1, line 17 "enerate" should read -- generate --.

Column 9, claim 1, line 29 "indication" should read -- induction --.

Column 10, claim 2, lines 33-36 delete "loop on the ... greater than the".

Signed and Sealed this

*Seventeenth* Day of *March 1981*

[SEAL]

*Attest:*

RENE D. TEGTMEYER

*Attesting Officer*

*Acting Commissioner of Patents and Trademarks*